US006322075B1

(12) United States Patent
DeFranco

(10) Patent No.: US 6,322,075 B1
(45) Date of Patent: Nov. 27, 2001

(54) BLACKJACK-TYPE CARD GAME

(76) Inventor: Ann DeFranco, 1080 Stoneham St., Superior, CO (US) 80027

( * ) Notice: Subject to any disclaimer, the term of this patent is extended or adjusted under 35 U.S.C. 154(b) by 0 days.

(21) Appl. No.: 09/354,580

(22) Filed: Jul. 16, 1999

(51) Int. Cl.[7] ..... A63F 3/08
(52) U.S. Cl. ..... 273/274; 463/12; 273/292
(58) Field of Search ..... 273/274, 292; 463/13, 12

(56) References Cited

U.S. PATENT DOCUMENTS 4,659,087 * 4/1987 Shen .
5,411,268 * 5/1995 Nelson .
5,577,731 * 11/1996 Jones .
5,720,484 * 2/1998 Hsu .
5,788,241 * 8/1998 Ung .

OTHER PUBLICATIONS

Scarne's Banking card game chapter 16 (pp. 276–290), 1973.*
Scarne's Draw poker chapter 2 (pp. 6–32), 1973.*

* cited by examiner

*Primary Examiner*—Benjamin H. Layno
*Assistant Examiner*—Vishu Mendiratta
(74) *Attorney, Agent, or Firm*—John B. Dickman, III

(57) ABSTRACT

A Blackjack-type card game where each player receives a four playing card array arranged in a square, with two of the cards face-up and two face down. Wagers are made on at least one and at most three of the six possible different two-cards of the array, betting against the dealer's hand. A dealer's hand consists of two cards, one card face-up and one card face-down. The dealer's play is governed by traditional Blackjack rules.

3 Claims, 1 Drawing Sheet

BLACKJACK-TYPE CARD GAME

BACKGROUND OF THE INVENTION

Casinos and gaming rooms are popular throughout the world. All kinds of games of chance provide hours of enjoyment to many people, and when wagering is added, the excitement is magnified, as for example with a fast-played game like Blackjack.

In playing Blackjack, a player or players, up to seven, plays against a dealer trying to better the dealer's hand by having a total count of 21 without going bust. Each player and the dealer are dealt two cards; in turn each player may draw additional cards in order to better his total count at the risk of going over 21, or busting. There are other complexities of Blackjack, such as "doubling down" on one's bet or "splitting" a hand which regular players know and understand. In the present method of play the dealer must draw a card if he has less than a 17 count, and must stand pat if he has over 17; the player or players, however, do not draw cards and therefore cannot go bust. Second, in the present method of play players may not double down on a bet nor may they split a hand. Finally, in the present method of play players can bet on up to three hands where one or both cards are face-down. Because of the uniqueness of the game, a player can win on up to three blackjack hands, each paying 3:2 on their wagers.

SUMMARY OF THE INVENTION

It is assumed that the rules of traditional Blackjack are known. Only the value of the cards is counted; the card suits are irrelevant. Cards 2 through 10 have their face value. The Jacks, Queens and Kings all have a value of 10. Aces may have a value of 1 or 11 at the option of the card holder. The jargon of the game includes the following terms: "blackjack" (a two-card hand comprising an Ace and a ten-value card; this is the best possible hand and beats a 21-value hand), "push" (the player's hand total is equal in value to the dealer's hand total in which case the player neither wins nor loses), "draw" (sometimes called "hit"; to add another card to a hand in an attempt to gain a better hand total), "stand" (to add no more cards to a hand), and "bust" (to draw a card that causes the hand total to exceed 21, thus making the hand a loser).

The method of play begins with dealing two cards to each player, one card to the dealer, two more cards to each player, and one more card to the dealer. A player's hand has two cards face-up and two cards face-down. The dealer's hand consists of one card face-up and one card face-down.

A player's hand is arranged in a four-card array, which presents the player with six different two-card hands: one with the face-up cards, one with the face-down cards, and four with one face-up card and one face-down card.

A player can only play the cards he is dealt, in other words there are no additional hits (additional cards) for a player. Only the dealer can draw additional cards. Since a player has six different combinations, he must decide which are the best hands on which to bet, for up to three wagers. The initial wager is assigned to one of the hands, and additional wagers cannot exceed the initial wager.

The dealer turns up his down card and determines if additional cards are needed to get to or close to 21. Once the dealer's hand is determined, the down cards of each player are turned up. If the dealer's total is less, he pays winning hands at the rate of 1:1. If a player's hand is less than the dealer's, he loses that hand. In the event that a wagered hand is blackjack, the player is paid at the rate of 3:2.

DESCRIPTION OF THE INVENTION

Figure 1:
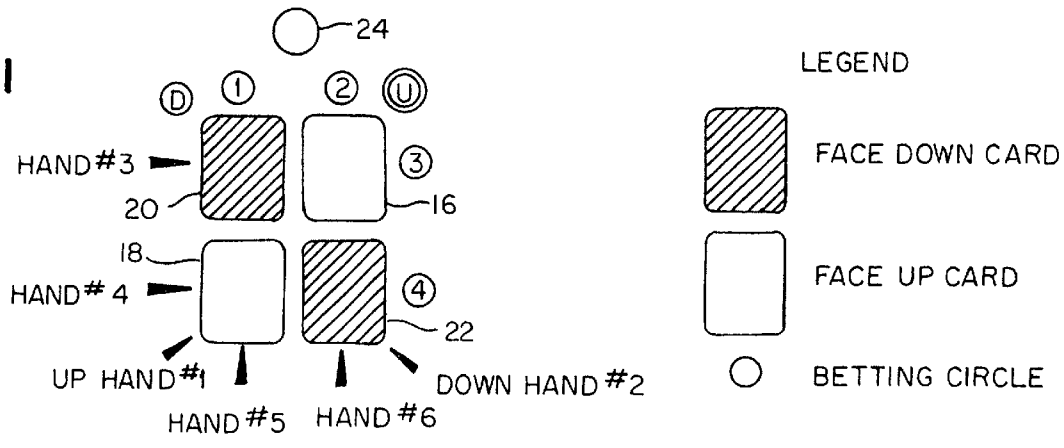
FIG. 1 shows a player's hand consisting of a four-card array, two cards face-up and two cards face-down, and six betting circles.
Figure 2:
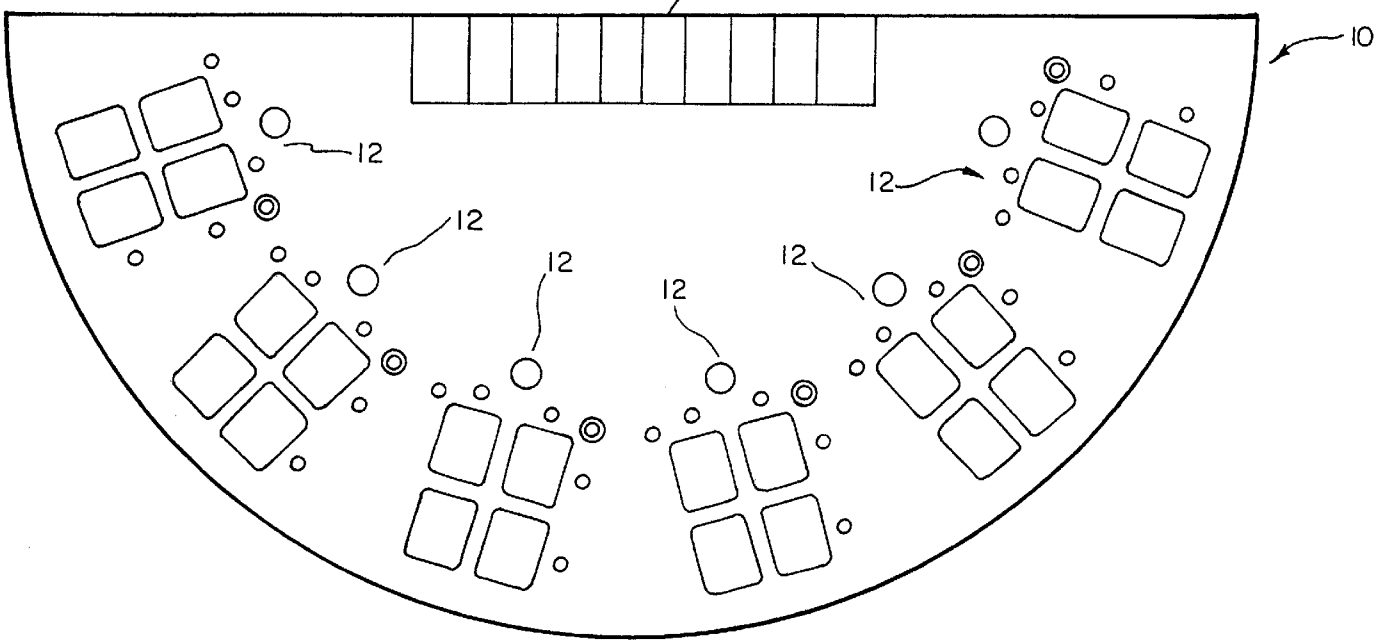
FIG. 2 shows a table configuration with six player's positions and a dealer's position.

Turning to the drawings, FIGS. 1 and 2, there is shown a gaming table 10 having six players positions 12 and a dealer's position 14. FIG. 1 shows a player's array of four cards having two face-up cards 16 and 18, and two face-down cards 20 and 22. Direction arrows show the six different hands available to a player. Hand one is the two face-up cards 16 and 18, hereafter referred to as the "up hand." Hand two is the two face-down cards 20 and 22. Hand three includes cards 16 and 20. Hand four includes cards 18 and 22. Hand five includes cards 18 and 20. And hand six includes cards 16 and 22. A player can only wager on the above combinations without any additional cards.

The dealer's hand (not shown) consists of one face-up card and one face-down card. The dealer can elect to take additional cards to reach 21.

The method of playing the Blackjack game of the invention begins with each player placing a wager in his initial bet circle 24 and the dealer dealing two cards to each player, one to himself, two more cards to each player, and one final card to himself. Each player's cards consist of two cards face-up and two cards face-down as shown in FIG. 1. The dealer's cards consist of one card face-up and one card face-down. As stated, the player's four-card array provides six different two-card hands.

After the cards are dealt, it must be determined first if the dealer or any players have blackjack by looking at the up cards for any Aces or 10-value cards. If the dealer has one of these showing, he then looks at the down card for a possible blackjack. The dealer does this in such a way as to prevent the players from seeing the value of the down card. If the dealer has blackjack, all play ceases on all arrays. If any player's up hand is blackjack, that player retains his initial bet. All other non-blackjack players lose their bet.

In the case where the dealer does not have blackjack but one or more players do, that player or players is paid 3:2 on his initial bet. However, if any player has an up hand of 12 or less, the initial bet is forfeited, with the exception of the Ace-Ace hand for which regular play continues. Should a player have blackjack or 12 or less, play is concluded and the player proceeds to bet on his array.

A player can assign his initial wager to a hand in one of two ways: a player wagers on his up hand only, or he wagers on one of hands two through six, and may elect to place up to two additional wagers on other hands of his array for a maximum of three wagers. Should a player elect this option, he is not allowed to wager on the up hand. Further, a player cannot add to his initial wager, nor can he wager more than the initial bet amount on other hands.

When the dealer's hand total has been determined, the down cards of each player who has bet on his array are turned up by the dealer. The wagered hand totals are compared to the dealer's hand total. If the dealer's hand total is less, the payout is as follows: the dealer pays non-blackjack winning hands (any hand greater than the dealer's hand) at the rate of 1:1. If a player's hand is a blackjack, he is paid 3:2 on his bet for that hand. If a player's hand ties the dealer's hand, this is a "push" and the player retains his original bet. However, if a player's hand is less than the dealer's hand, he loses his bet on that hand. If the dealer goes bust, then all wagered hands are paid at the rate of 1:1, except blackjack hands which are paid 3:2.

To determine the dealer's hand total, he turns up his down card. Here, the dealer's play is governed by the same rules as in traditional Blackjack, that is, draw a card when his hand total is 2 to 17, and stand on 17 or better. If the dealer's hand exceeds 21, he is said to go bust. Should the dealer have an Ace he may be required to draw a card; this rule may be applied in the present game without changing the nature or scope of the game.

After the wagers on winning hands have been paid to a player and wagers on losing hands have been collected from a player, the dealer gathers the played cards and places them in the discard pile. When all the player's cards have been discarded, a new round of play begins.

While only one method of play has been described, it is understood that one skilled in the art may realize other embodiments, therefore, one should study the specification, drawings and claims for a full understanding of the invention.

What is claimed:

1. A method of playing a Blackjack-type card game with a dealer and at least one player comprising the steps of:

a player placing an initial wager;

the dealer dealing the player four cards such that the cards present the player a plurality of hands, and dealing himself two cards;

the four cards dealt to the player arranged in two-by-two array;

two cards of the four being face-down and two face-up, the two face-down cards are in the upper left and lower right positions, and the two face-up cards are in the upper right and lower left positions;

the player forfeiting his initial wager in the event that his cards contain a certain predetermined losing hand;

a bonus winning payout being paid on the initial wager in the event that the player's cards contain a certain predetermined winning hand;

the player assigning his initial wager to one hand;

the player electing whether to place additional wagers on other hands, and the dealer completing his hand in accordance with conventional Blackjack rules.

2. A method of playing a Blackjack-type card game according to claim 1 wherein the predetermined losing hand comprising the face-up cards having a total card value of 12 or less except when both face-up cards are Aces.

3. A method of playing a Blackjack-type card game according to claim 1 wherein the predetermined losing hand comprises the face-up cards having a total card value of 10, 11, 12, or 13 except when both face-up cards are Aces.

* * * * *